US007836520B2

(12) United States Patent
Marquis et al.

(10) Patent No.: US 7,836,520 B2
(45) Date of Patent: Nov. 23, 2010

(54) TWO-PIECE GARMENT

(75) Inventors: Noemi Marquis, Montreal (CA); Denyse Roy, Verdun (CA)

(73) Assignee: Valorisation-Recherche, Limited Partnership, Montreal, Quebec (CA)

( * ) Notice: Subject to any disclaimer, the term of this patent is extended or adjusted under 35 U.S.C. 154(b) by 611 days.

(21) Appl. No.: 11/403,289

(22) Filed: Apr. 13, 2006

(65) Prior Publication Data

US 2006/0242747 A1 Nov. 2, 2006

Related U.S. Application Data

(60) Provisional application No. 60/671,479, filed on Apr. 15, 2005.

(51) Int. Cl.
*A41D 10/00* (2006.01)

(52) U.S. Cl. ..... 2/114

(58) Field of Classification Search ..... 2/114, 2/77, 115, 75, 80, 104, 74, 111
See application file for complete search history.

(56) References Cited

U.S. PATENT DOCUMENTS 459,106 A * 9/1891 Fifield ..... 2/114
646,194 A * 3/1900 Sims ..... 2/114
818,351 A * 4/1906 Clark ..... 2/114
1,155,544 A * 10/1915 Bonoff ..... 2/48
1,233,156 A * 7/1917 Zies ..... 2/114
1,254,043 A * 1/1918 James ..... 450/31
1,462,515 A * 7/1923 McElroy ..... 2/72
2,035,377 A * 3/1936 Redmond ..... 2/111
2,068,186 A * 1/1937 Le Coney ..... 2/111
2,425,402 A * 8/1947 Sieloff ..... 2/75
2,462,165 A * 2/1949 Condon ..... 2/69.5
2,768,383 A * 10/1956 De Witt ..... 2/114
2,803,825 A * 8/1957 Schiek ..... 2/75
2,890,460 A * 6/1959 Levi ..... 2/144
3,155,984 A * 11/1964 Derrick ..... 2/114
3,369,256 A * 2/1968 Kern ..... 2/114
3,609,767 A * 10/1971 Grosz ..... 2/114
3,751,730 A * 8/1973 Zamist ..... 2/114
3,877,078 A * 4/1975 Tepper ..... 2/74
4,078,265 A * 3/1978 Condit ..... 2/115
4,296,498 A * 10/1981 Vinson ..... 2/115

(Continued)

*Primary Examiner*—Alissa L Hoey
(74) *Attorney, Agent, or Firm*—Ladas & Parry LLP

(57) ABSTRACT

A garment assembly for a human body comprising a first garment element and a second garment element. The first garment element comprising a top end having a first neck opening, left and right lateral sides having left and right first arm openings respectively, a front side, a back side having an opening, and a bottom end. The second garment element comprising a top end having a second neck opening, left and right lateral sides having respective left and right second arm openings respectively, a front side having an opening, a back side, and a bottom end. When assembling the first and second garment elements on a human body, the first and second neck openings provide for the neck of the human body to be placed therethrough, the first garment element front side covers the front of the human body, the second garment element back side covers the back of the human body. The left first and second arm openings provide for the left arm of the human body to be placed therethrough and the right first and second arm openings provide for the right arm of the human body to be placed therethrough.

22 Claims, 8 Drawing Sheets

U.S. PATENT DOCUMENTS 4,653,120 A * 3/1987 Leaf ..... 2/114
4,686,714 A * 8/1987 Harley ..... 2/105
4,686,715 A * 8/1987 Price ..... 2/114
4,718,124 A * 1/1988 Sawicki et al. ..... 2/114
4,754,500 A * 7/1988 Brucato et al. ..... 2/105
4,797,954 A * 1/1989 Williams et al. ..... 2/106
4,969,215 A * 11/1990 Burkett ..... 2/114
5,029,344 A * 7/1991 Shannon et al. ..... 2/69
5,444,872 A * 8/1995 Johnson ..... 2/114
5,561,860 A * 10/1996 Nguyen-Senderowicz ..... 2/90
5,572,742 A * 11/1996 McFadden ..... 2/114
5,611,087 A * 3/1997 Adkins ..... 2/114
5,946,726 A * 9/1999 Green ..... 2/109
5,991,923 A * 11/1999 Maria ..... 2/83
6,006,356 A * 12/1999 Song ..... 2/69
6,012,166 A * 1/2000 Burbidge ..... 2/83
6,032,288 A * 3/2000 Simone ..... 2/69
6,059,633 A * 5/2000 Currier ..... 450/31
6,134,715 A * 10/2000 McLennan ..... 2/114
6,216,271 B1 * 4/2001 Chen ..... 2/69
6,237,153 B1 * 5/2001 Bowens ..... 2/114
6,345,393 B1 * 2/2002 Bayer ..... 2/94
6,694,521 B1 * 2/2004 Hopkins ..... 2/83
7,143,449 B2 * 12/2006 Young ..... 2/69
7,305,716 B1 * 12/2007 Richards ..... 2/114
7,395,556 B2 * 7/2008 Eraca ..... 2/104
2003/0126668 A1 * 7/2003 Scroggins ..... 2/114
2005/0028243 A1 * 2/2005 Polzin ..... 2/104
2005/0257309 A1 * 11/2005 Knoefel et al. ..... 2/114
2006/0277655 A1 * 12/2006 Kerr ..... 2/114
2007/0174945 A1 * 8/2007 Lehane ..... 2/104
2008/0172771 A1 * 7/2008 Adamson ..... 2/104

* cited by examiner

TWO-PIECE GARMENT

CROSS REFERENCE TO RELATED APPLICATIONS

This application claims priority on U.S. provisional application No. 60/671,479 filed on Apr. 15, 2005 the content of which is herein incorporated by reference in its entirety.

FIELD OF THE INVENTION

The present invention generally relates to protective garments. More specifically, but not exclusively, the present invention is concerned with a garment element designed to be used alone or to form a two-piece garment. The present invention is also concerned with this two-piece garment. The present invention is also concerned with a patient garment element designed to be used alone or to form a two-piece garment. The present invention is also concerned with this two-piece patient garment.

BACKGROUND OF THE INVENTION

Protective cover garments such as coveralls useful in applications where contact is likely with dirt, liquids, paint or other contaminants are well known. These protective garments include patient garments as well.

Patient garments include the well known, conventional hospital gowns. A hospital gown is a short gown with no collar and with an opening in the back for wear by hospital patients. To close the back opening, the conventional hospital gowns comprise two pairs of laces at the neck on both sides of the back opening and at the middle back and the side under the left arm. These laces can be attached together to close the opening and cover the patient's body. These laces also make the conventional gown non reversible.

A major drawback of the conventional hospital gowns is related to the laces disposed on the opposite sides of the back opening. Unless these laces are appropriately attached, the back opening remains open and the patient's body is exposed. Since the laces are disposed on the back of the hospital gown, in many instances they cannot be reached by the patient and remain unattached. This results in exposition of the body of the patients who, for that reason, have a feeling of lack of intimacy.

In many instances, patients wear two hospital gowns to be decently covered.

SUMMARY OF THE INVENTION

An object of the present invention is to provide a garment element designed to be used alone in the case of a patient confined to bed and, in the alternative, to form a two-piece garment. Another object of the present invention is to provide a two-piece patient garment comprising two of these garment elements.

More specifically, in accordance with an aspect of the present invention, there is provided a garment assembly for a human body comprising: a first garment element comprising a top end having a first neck opening, left and right lateral sides having left and right first arm openings respectively, a front side, a back side having an opening, and a bottom end, and a second garment element comprising a top end having a second neck opening, left and right lateral sides having respective left and right second arm openings respectively, a front side having an opening, a back side, and a bottom end, wherein when assembling the first and second garment elements on a human body, the first and second neck openings provide for the neck of the human body to be placed therethrough, the first garment front side covers the front of the human body, the second garment back side covers the back of the human body, the left first and second arm openings provide for the left arm of the human body to be placed therethrough, and the right first and second arm openings provide for the right arm of the human body to be placed therethrough.

In accordance with another aspect of the present invention, there is provided a garment element for a garment assembly for a human body, the garment element comprising a top end having a neck opening, left and right lateral sides having left and right arm openings respectively, a pair of opposite faces between the lateral sides, one of the opposites faces having an opening, the other of the opposites faces providing for covering the front or the back of the human body when mounted thereto, and a bottom end, wherein when assembling two like garment elements on a human body the respective faces having at the opening of each the two like garment being placed on respective opposite front and back sides of the human body, each of the other opposite faces of the two like garments covering a respective front or back side of the human body.

The terms "front" and "back" when referring to the faces of a garment element are used herein throughout for indicative purposes only and as such are interchangeable. The terms "first" and "second" when referring to the garment elements are used herein throughout for indicative purposes only and as such are interchangeable. Therefore, a first garment element may be placed on the front of the body with an opening in the back or vice versa, a second garment element may be placed on the back of the body with an opening in the front or vice versa to give but two non-restrictive examples.

The foregoing and other objects, advantages and features of the present invention will become more apparent upon reading of the following non-restrictive description of illustrative embodiments thereof, given by way of example only with reference to the accompanying drawings.

DETAILED DESCRIPTION OF THE ILLUSTRATIVE EMBODIMENTS

Non-restrictive illustrative embodiments of the garment element and two-piece patient garment will now be described in connection to FIGS. 1-12 of the appended drawings.

Figure 2:
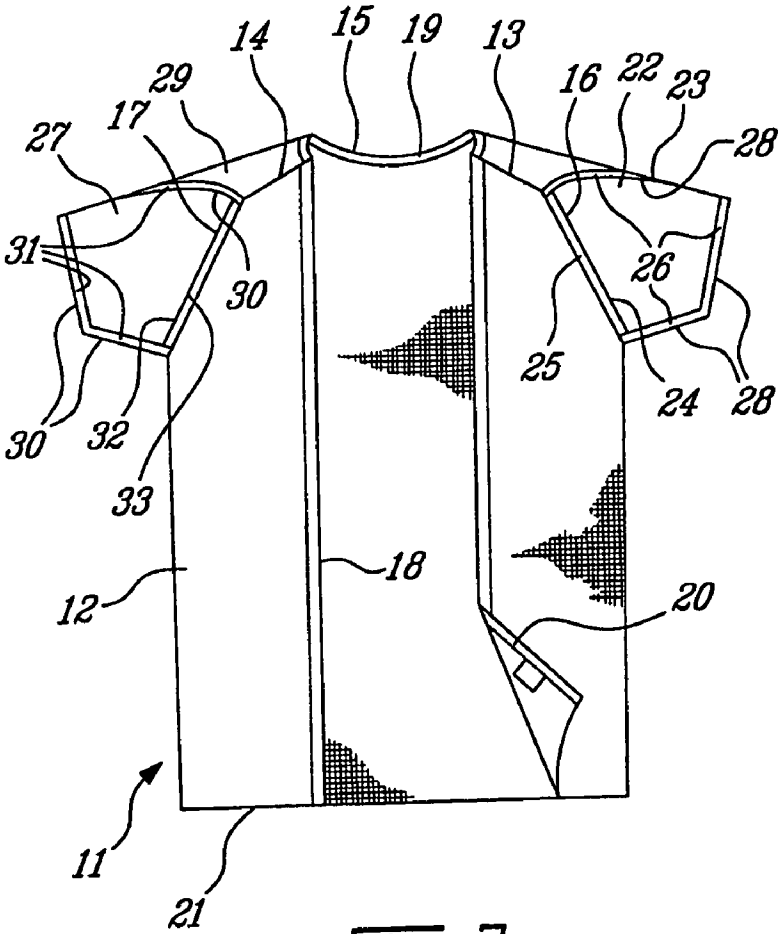
FIG. 2 is a back, respectively front elevational view of the first non-restrictive illustrative embodiment of the garment element according to the present invention.
Figure 1:
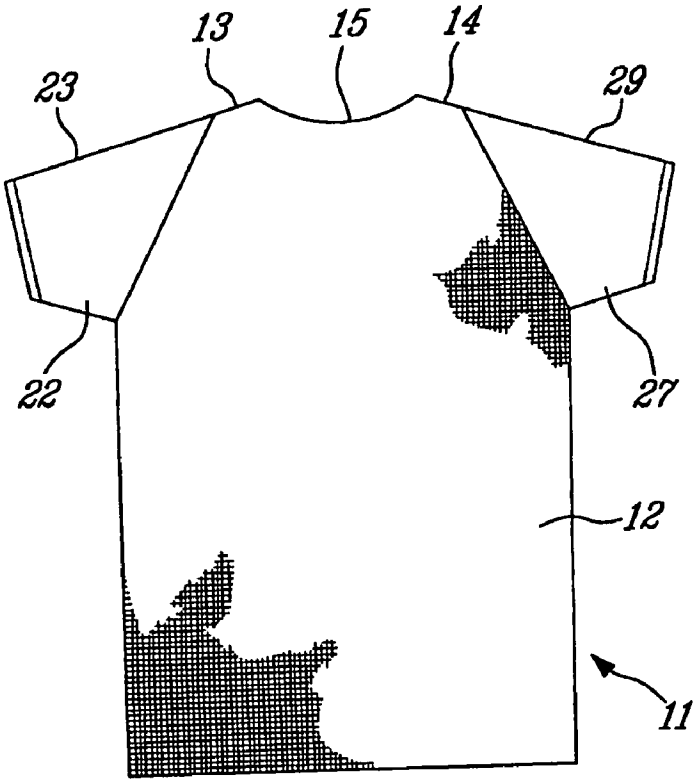
FIG. 1 is a front, respectively back elevational view of a first non-restrictive illustrative embodiment of the garment element according to the present invention.

Referring to FIGS. 1 and 2 of the appended drawings, a first non-restrictive illustrative embodiment of the garment element is generally identified by the reference 11.

The garment element 11 comprises a main piece of suitable material 12 destined to cover the wearers shoulders, trunk and legs. The piece of material 12 is cut to define, when the pair of edges 13 and the pair of edges 14 are sewed together, a neck opening 15, arm openings 16 and 17 (better shown in FIG. 2) and a rectangular back, respectively front opening 18 (FIG. 2). A bias binding or hem 19, or any other finishing can be formed around the neck opening. In the same manner, a bias binding or hem 20, or any other finishing can be formed around the rectangular back, respectively front opening 18 and also along the lower edge 21 of the piece of material 12 (FIG. 2).

Another piece of suitable material 22 can be sewed around the arm opening 16 to form a portion of short sleeve 23 covering the front, respectively back side and the top of the wearer's shoulder and arm. The exposed edges 28 of the sleeve 23 can be provided with a bias binding or hem 26, or any other finishing. In the same manner, the portion 24 of the arm opening 16 not sewed to the piece of material 22 can be provided with a bias binding or hem 25, or any other finishing.

A further piece of suitable material 27 can be sewed around the arm opening 17 to form a portion of short sleeve 29 covering the front, respectively back side and the top of the wearer's shoulder and arm. The exposed edges 30 of the sleeve 29 can be provided with a bias binding or hem 31, or any other finishing. In the same manner, the portion 32 of the arm opening 17 not sewed to the piece of material 27 can be provided with a bias binding or hem 33, or any other finishing.

The pieces of material 12, 22 and 27 can be made of any suitable material such as woven, knitted or non-woven fabrics made of natural and/or man-made fibers, including synthetics. Also, in an embodiment where the garment element is disposable after use, the pieces of material 12, 22 and 27 can be made of disposable material such as paper material or polymeric fabric or any type of recycled or recyclable material.

Figure 4:
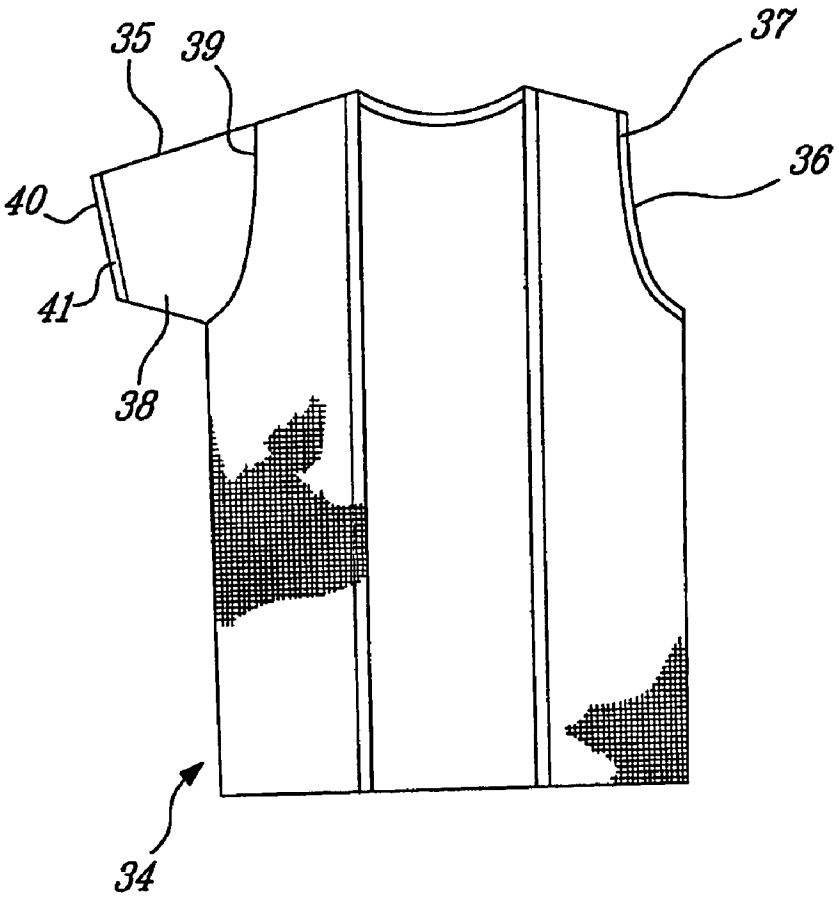
FIG. 4 is a back, respectively front elevational view of the second non-restrictive illustrative embodiment of the garment element according to the present invention.
Figure 3:
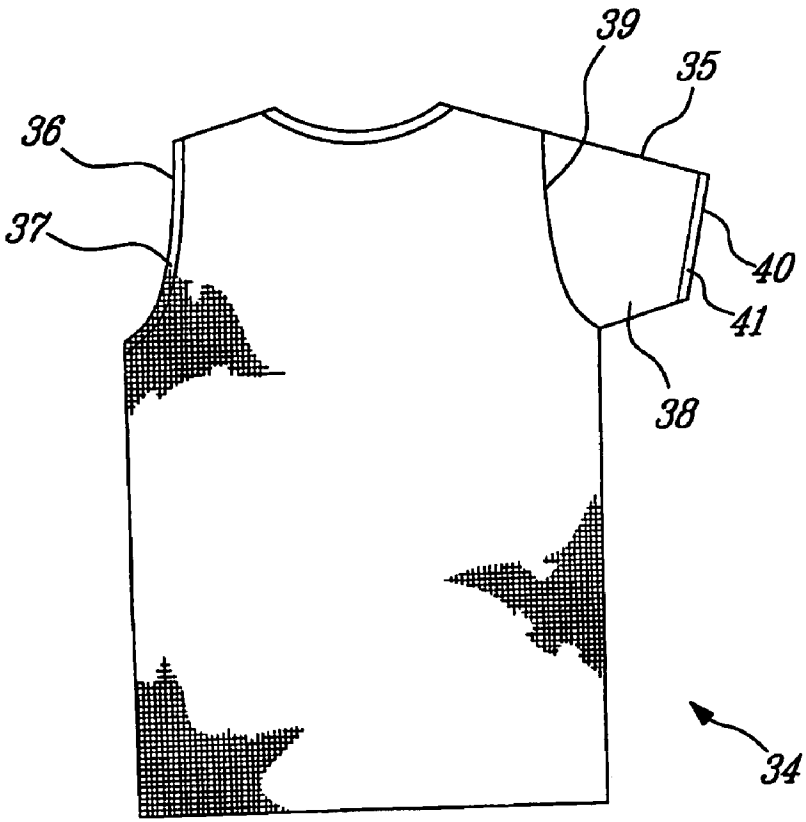
FIG. 3 is a front, respectively back elevational view of a second non-restrictive illustrative embodiment of the garment element according to the present invention.

Referring to FIGS. 3 and 4 of the appended drawings, a second non-restrictive illustrative embodiment of the garment element is generally identified by the reference 34. For the sake of simplicity, only the differences between the second embodiment of FIGS. 3-4 and the first embodiment of FIGS. 1-2 will be described.

As illustrated in FIGS. 3 and 4, the garment element 34 comprises only one sleeve 35.

The arm opening 36 remains open although it can be provided with a bias binding or hem 37, or any other finishing.

As can be seen, the sleeve 35 is a short sleeve covering the front and back sides, the top and the underside of the wearer's shoulder and arm. The sleeve 35 is formed of a piece of suitable material 38 sewed around the arm opening 39. The free end edge 40 of the sleeve 35 can be provided with a bias binding or hem 41, or any other finishing.

Figure 6:
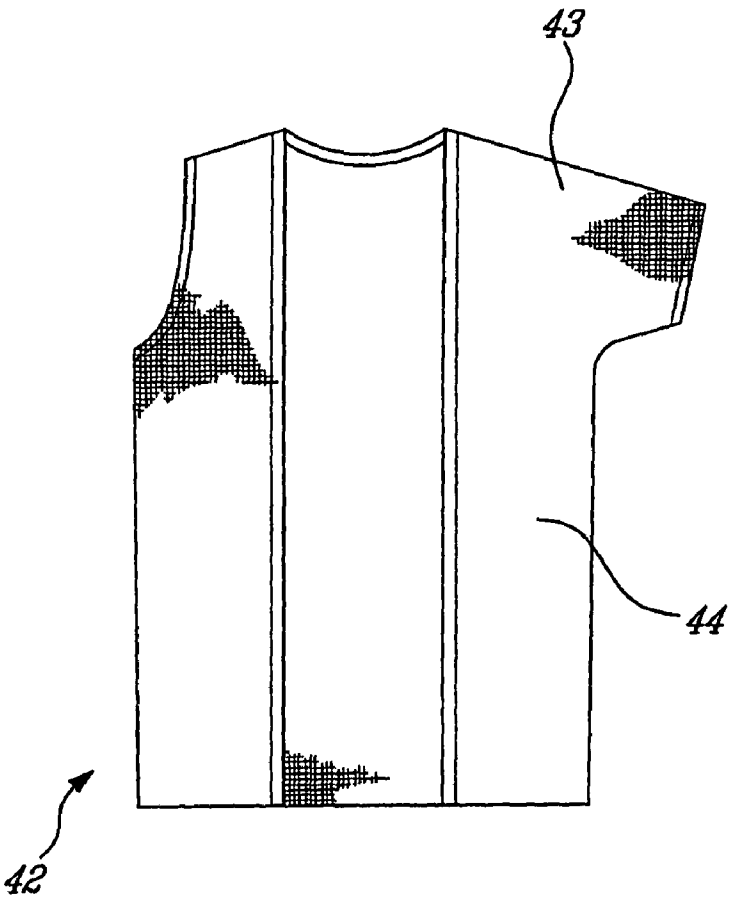
FIG. 6 is a back, respectively front elevational view of the third non-restrictive illustrative embodiment of the garment element according to the present invention.
Figure 5:
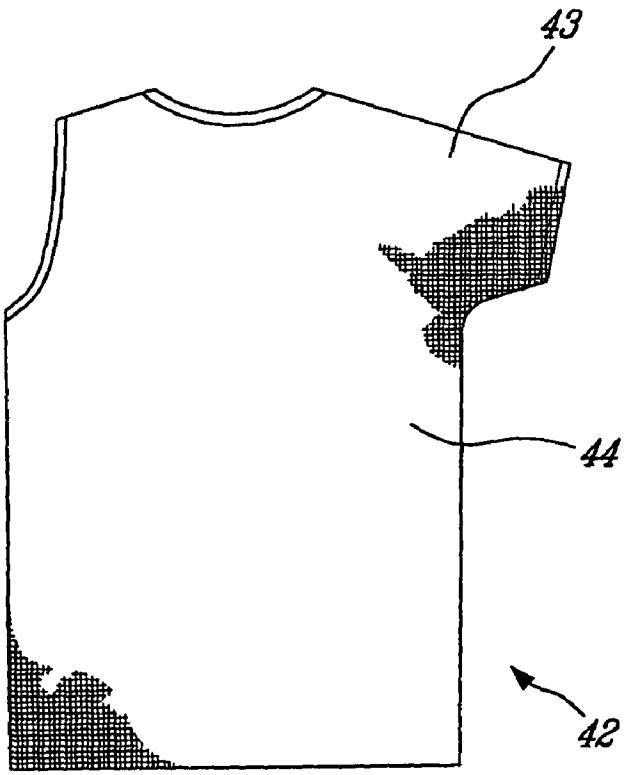
FIG. 5 is a front, respectively back elevational view of a third non-restrictive illustrative embodiment of the garment element according to the present invention.

The difference between the third non-restrictive illustrative embodiment of the garment element 42 as illustrated in FIGS. 5 and 6 and the second non-restrictive illustrative embodiment of the garment element 34 as shown in FIGS. 3 and 4 is that the single short sleeve 43 of the third embodiment is of the kimono type; there is no sewing between the arm opening and the material of the short sleeve 43.

Figure 8:
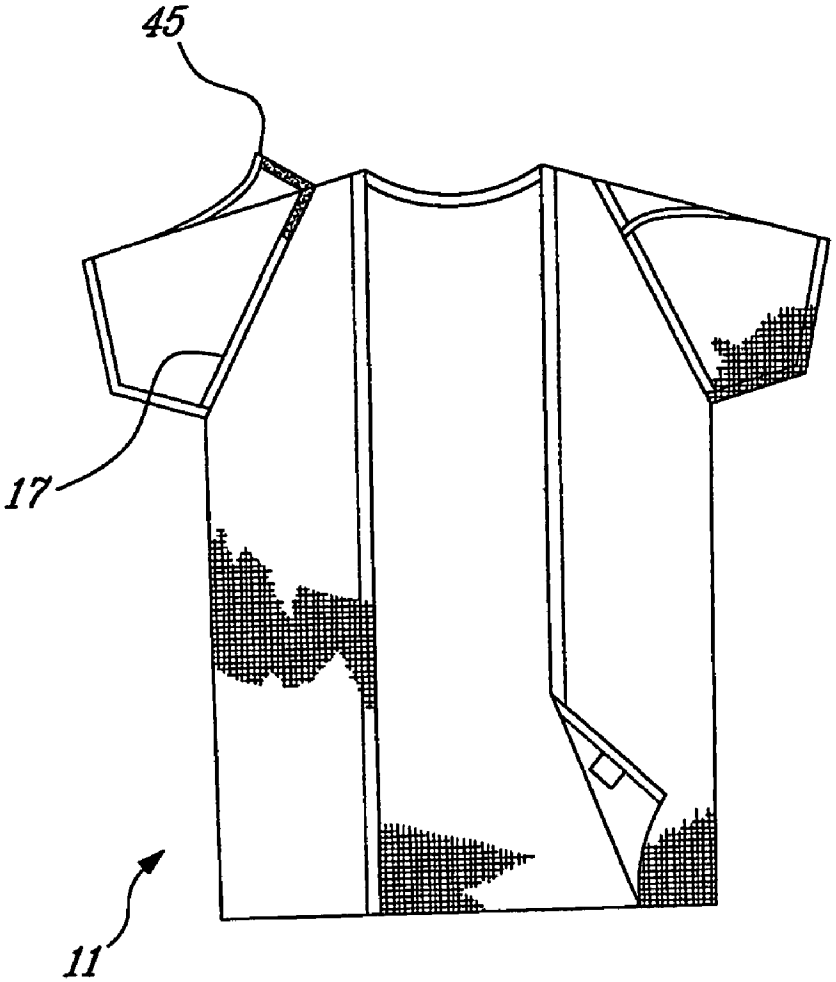
FIG. 8 is a back, respectively front elevational view of the first modified version of the first non-restrictive illustrative embodiment of garment element as illustrated in FIG. 2.
Figure 7:
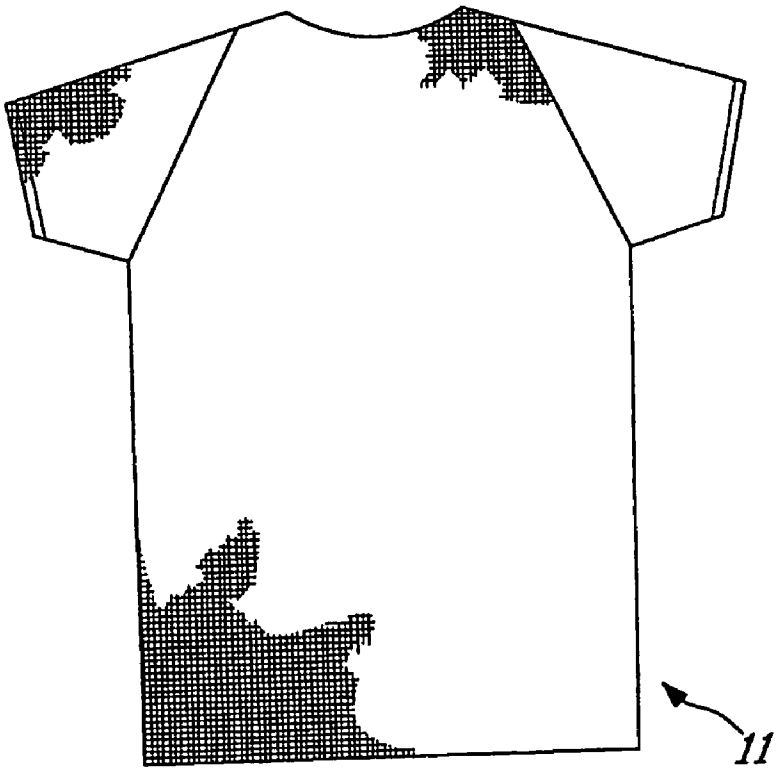
FIG. 7 is a front, respectively back elevational view of a first modified version of the first non-restrictive illustrative embodiment of garment element as illustrated in FIG. 1.

FIGS. 7 and 8, in particular FIG. 8, illustrate a first modified version of the first non-restrictive illustrative embodiment of garment element as illustrated in FIGS. 1 and 2. More specifically, the junction between the inner top corner 45 of the sleeve 29 of FIGS. 1 and 2 is removably attached to the contour of the arm opening 17 through a suitable fastener such as a snap fastener, Velcro™ strips, or any other suitable fastener. This will allow passage of a tube conveying solute toward a patient confined to bed or through which an intravenous treatment is performed upon putting the garment element 11 on that patient.

Figure 10:
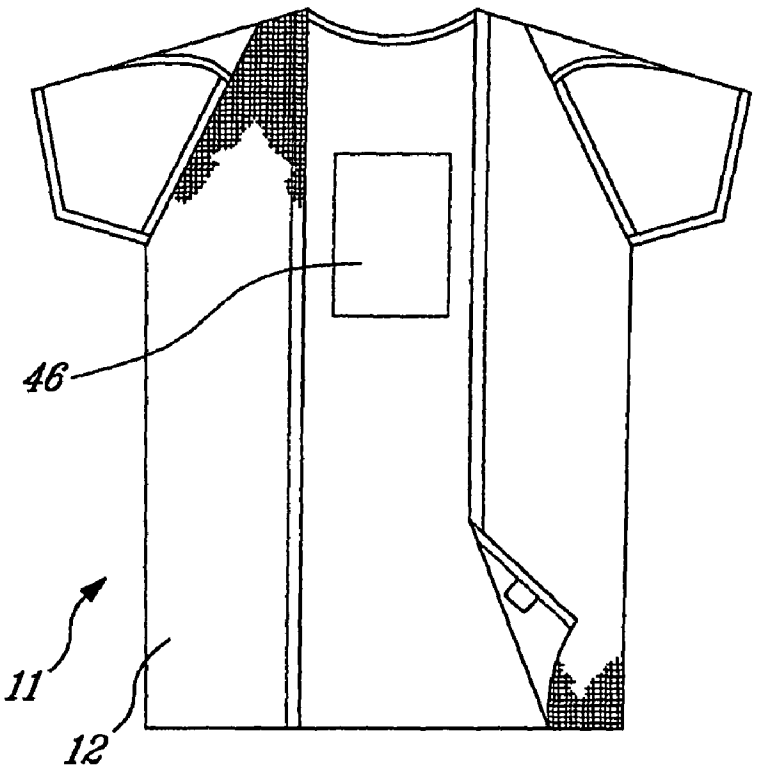
FIG. 10 is a back, respectively front elevational view of the second modified version of the first non-restrictive illustrative embodiment of garment element as illustrated in FIG. 2.
Figure 9:
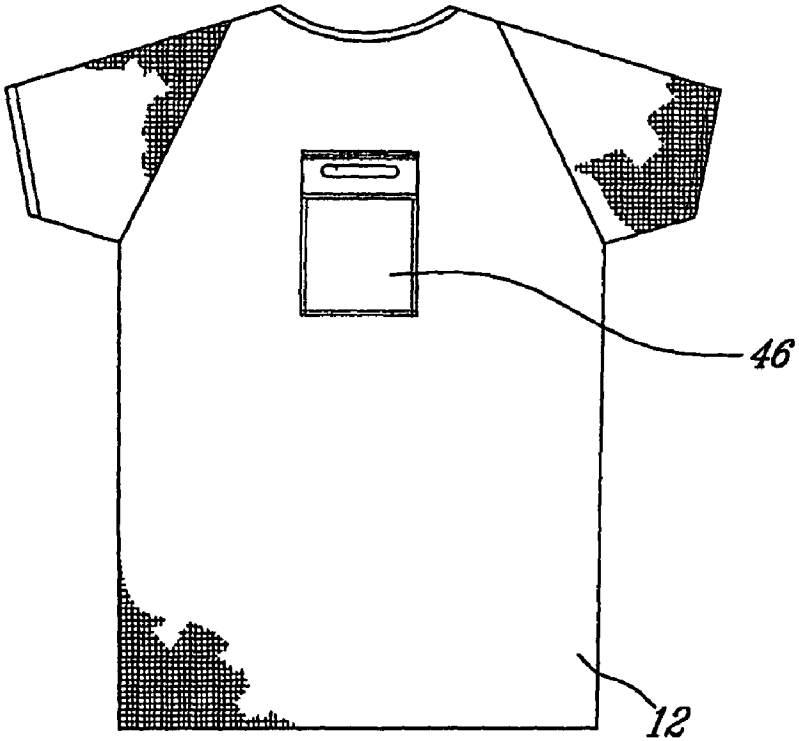
FIG. 9 is a front, respectively back elevational view of a second modified version of the first non-restrictive illustrative embodiment of garment element as illustrated in FIG. 1.

As illustrated in FIGS. 9 and 10, the non-restrictive illustrative embodiment of garment element 11 as illustrated in FIGS. 1 and 2 can be modified to provide a pocket 46 adapted to receive, in particular but not exclusively, a telemetry system capable of detecting and transmitting, through a wireless connection, bioelectrical signals representative of the patient's vital signs. This will enable remote monitoring of the patient's vital signs by the medical staff. As illustrated in FIGS. 9 and 10, this pocket 46 can be formed of a piece of the same material as the piece 12 of the garment element 11, suitably designed to receive the telemetry system and sewed to the piece of material 12 at an appropriate location.

Figure 11:
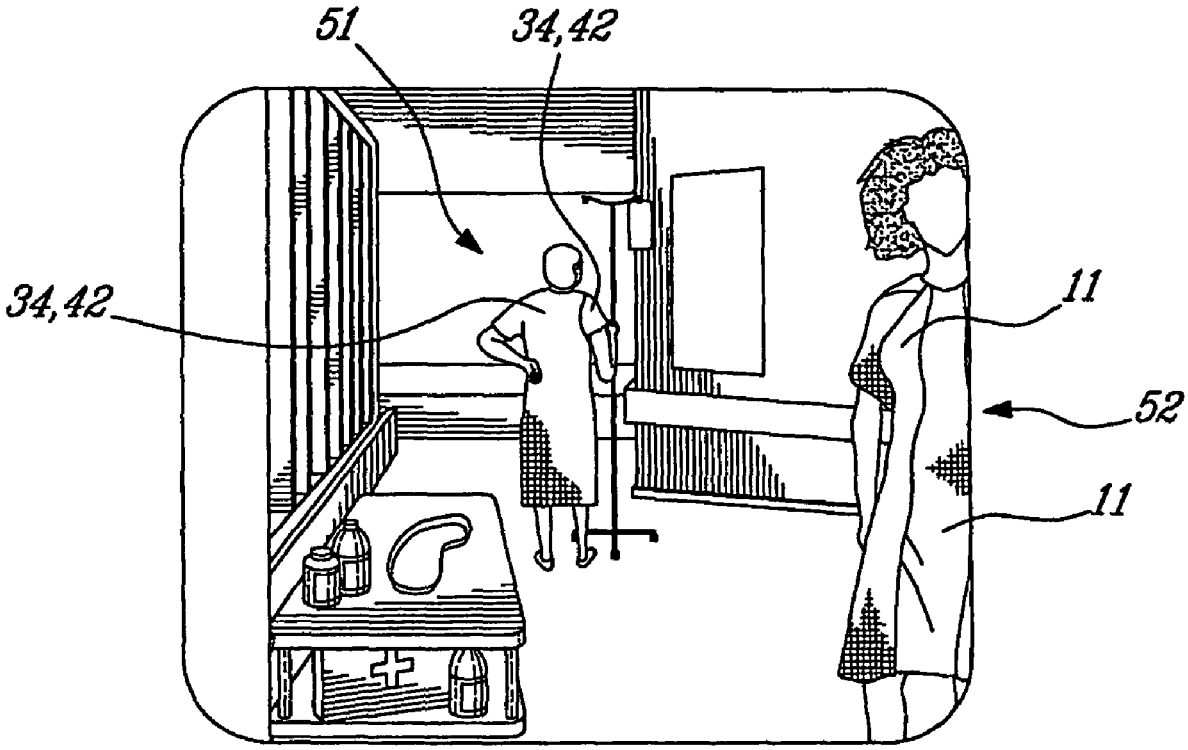
FIG. 11 is an illustration showing two patients wearing a non-restrictive illustrative embodiment of a two-piece patient garment according to the present invention, in the form of a hospital gown.

As illustrated in FIG. 11, to form, for example a hospital gown, a patient such as 52 puts on a first garment element 11 with the rectangular opening 18 on the back of the patient 52. The patient 52 then puts on a second garment element 11 over the first garment element, with the rectangular opening 18 of the second garment element on the front of the patient 52. As illustrated in FIG. 11, the material composing the first and second garment elements can be formed of fabric of different colors and different ornamental motifs. Since the first and second garment elements comprises only portions of short sleeves on the opposite sides of the patient's shoulders and arms, these portions of short sleeves minimally overlap each other to render the hospital gown more comfortable for the patient 52.

As also illustrated in FIG. 11, to form, for example a hospital gown, a patient such as 51 puts on a first garment element such as 34 or 42 with the rectangular opening on the back of the patient 51. The patient 51 then puts on a second garment element such as 34 or 42 over the first garment element, with the rectangular opening of the second garment element on the front of the patient 51. As shown in FIG. 11, the material composing the first and second garment elements can be formed of fabric of different colors and different ornamental motifs. Since the first and second garment elements each comprise only one short sleeve, each shoulder and arm of the patient is covered by only one sleeve to render the hospital gown more comfortable for the patient 52.

When the patient is confined to bed, he can wear only one garment element such as 11, with the rectangular opening 18 on the back of the patient.

Figure 12:
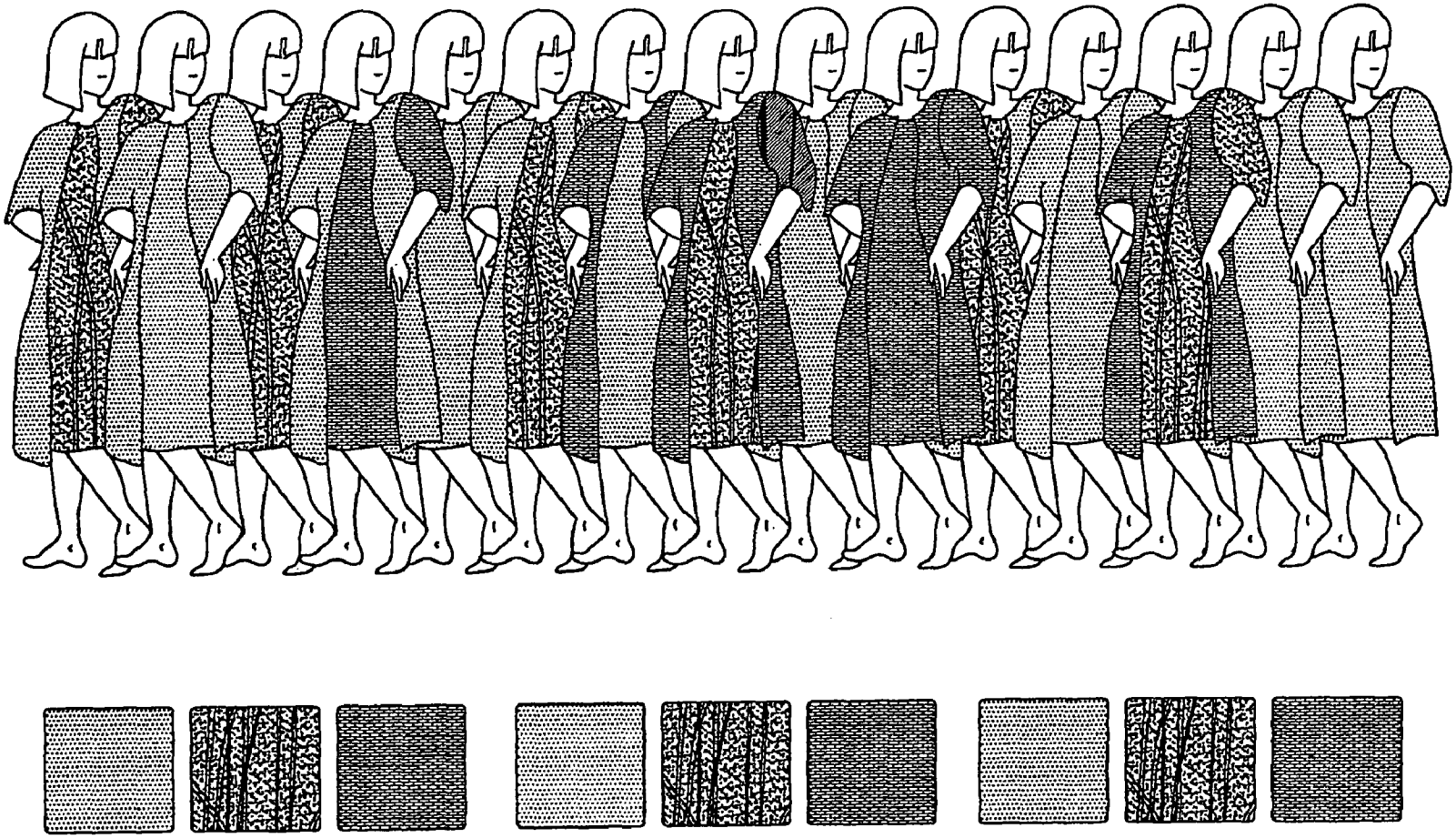
FIG. 12 is a schematic representation showing that, using nine (9) different colors and ornamental motifs, the two-piece patient garment of FIG. 11 provides for 81 permutations out of which 15 are illustrated.

FIG. 12 illustrates that, using three (3) different colors and three (3) ornamental motifs, the two-piece patient garment provides for 81 possible permutations. FIG. 12 show 15 out of these 81 possibilities.

Figure 14:
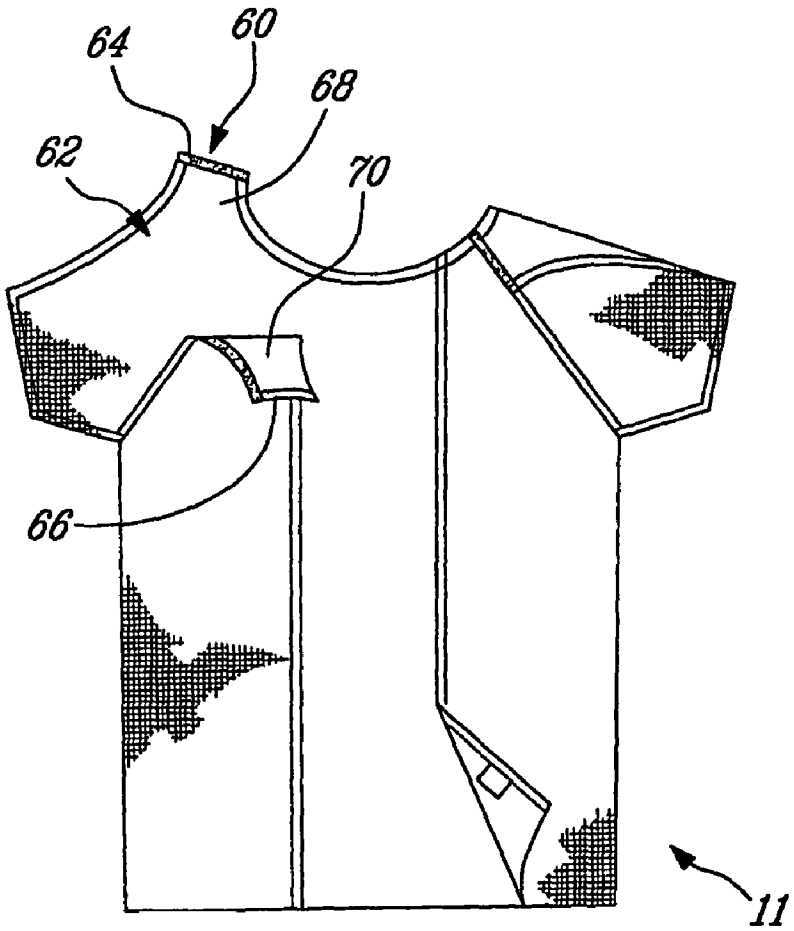
FIG. 14 is a back, respectively front elevational view of the third modified version of the first non-restrictive illustrative embodiment of garment element as illustrated in FIG. 2.
Figure 13:
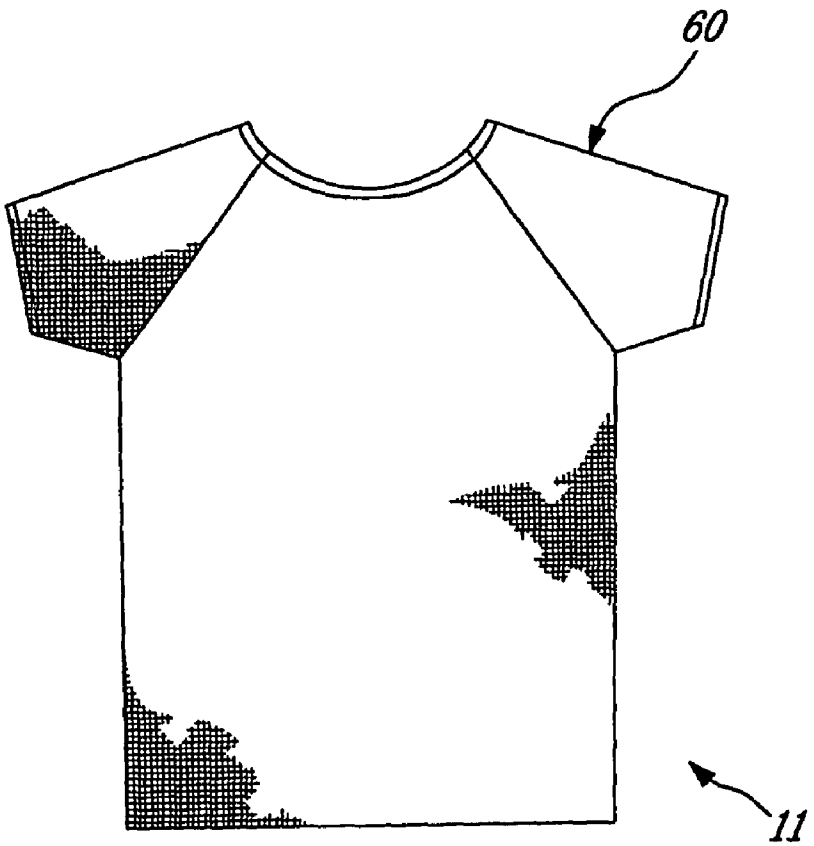
FIG. 13 is a front, respectively back elevational view of a third modified version of the first non-restrictive illustrative embodiment of garment element as illustrated in FIG. 1.

FIGS. 13 and 14 show a garment element 11 in accordance with a third modified version. As is shown in FIG. 14, this version of garment includes a shoulder covering portion 60 adjacent to an arm opening 62. The shoulder covering portion 60 is fully detachable at common meeting edges 64 and 66 defined by each separate shoulder parts such as flaps 68 and 70 respectively. Similarly to the modified version of FIG. 8, the common meeting edges may include a suitable fastener such as a snap fastener, Velcro™ strips, or any other suitable fastener. This fully detachable shoulder portion 60 provides for a physician, nurse or other medical professional to perform a variety of interventions on the patient wearing such a garment element 11 without removing the garment element. For example, when a patient is intubed or has their tube removed, the detachable portion 60 may be detached in either operation and then attached when this operation is completed without unduly inconveniencing the patient. Furthermore, the detachable portion 60 provides for the garment element 11 to be removed from the patient or put on the patient without moving the patient, when they are in bed for example, or disconnecting any solute tubes, intravenous conduits, or electrical monitoring links and the like. The detachable portion 60 may be partially or fully detachable (as shown in the drawings).

The sleeves of the various garment elements of the invention may be provided in a variety of lengths from full arm length, to medium to short sleeves depending on the needs of the wearer. Of course, the garment elements can be provided without sleeves as well.

The garment element and two-piece garment according to the above described non-restrictive illustrative embodiments present amongst others, the following advantages:

- each garment element can be made reversible to facilitate use, washing and handling of the garment element; no care is required to ensure that the outer face of the garment element is at the exterior and the inner face at the interior;
- the two garment elements of a two-piece garment, for example a hospital gown can be made interchangeable to facilitate use and improve the versatility of theses elements and garments;
- the patient wearing the two-piece garment, for example a hospital gown is adequately covered and, therefore, has a feeling of comfort and intimacy;
- although the patient wearing the two-piece garment, for example a two-piece hospital gown is adequately covered and has a feeling of intimacy, the patient's body is still accessible to allow the medical staff to administer tests and treatments and more generally to take care of the patient;
- a garment element can be put on a patient confined to bed and/or connected to intravenous equipment;
- a garment element can be used for female patients nursing newborn babies;
- the patient can easily put on the two-piece patient garment by himself or herself since no laces are required to close a back opening of the garment whereby the associated drawbacks are overcome;
- the laundry operation is capable of respecting more easily the hospital textile standards and no fastener can break or needs to be repaired;
- the two-piece garment renew the tactile and visual experience of the hospital gown;
- the garment element has an excellent durability and its shape is preserved even after repeated washing or dry-cleaning;
- the garment element and two-piece patient garment can be one-size element and garment designed and dimensioned to fit both women and men;
- the two-piece garment can be made of a combination of a disposable garment element and a non-disposable garment element.
- the two-piece garment is in conformity with standards required for patients in mental health institutions (for example, the two-piece garment does not need laces or detachable labels and the like);
- the two-piece garment can be used as protective wear for a variety of arts and crafts by any age group;
- the two-piece garment can be used as beach or swimwear;
- the two-piece garment can comprise garment elements having different dimensions;
- the two-piece garment can comprise garment elements that are identical.

The garment elements of the invention can be used to provide garments for other uses such as a protective garment useful in applications where contact is likely with dirt, liquids, paint or other contaminants or where decent covering of the human body is desirable.

The garment elements of the invention can be worn separately or assembled. Hence, the wearer can place either of the garment elements on the front or the back of their body in any order and on either side of the reversible garment elements, thereby facilitating use and stocking thereof. In fact for certain patients it may be desirable to wear such garment elements in a specific order depending on the ailment for example.

The various features and characteristics of the garment elements and two-piece garments (or two-piece garment assemblies) can be combined in a variety of ways to provide for other designs and configurations within the scope of the present invention.

Although the present invention has been described hereinabove by way of non-restrictive illustrative embodiments thereof, these embodiments can be modified without departing from the spirit and nature of the subject invention.

What is claimed is:

1. A garment assembly for a human body comprising:

a first garment element comprising a top end having a first neck opening, left and right lateral sides having left and right first arm openings respectively, left and right first sleeve portions about said left and right first arm openings respectively, a front side, a back side having an opening, and a bottom end, said front side extending from said top end to said bottom end and from said left lateral side to said right lateral side; and a second garment element being separate from said first garment element and comprising a top end having a second neck opening, left and right lateral sides having respective left and right second arm openings respectively, left and right second sleeve portions about said left and right second arm openings respectively, a front side having an opening, a back side, and a bottom end, said back side extending from said top end to said bottom end and from said left lateral side to said right lateral side wherein when assembling said separate first and second garment elements on a human body, said first and second neck openings provide for the neck of the human body to be placed therethrough, said first garment element front side covers the front of the human body, said second garment element back side covers the back of the human body, said left first and second arm openings provide for the left arm of the human body to be placed therethrough, said left first and second sleeve portions define a left sleeve, said right first and second arm openings provide for the right arm of the human body to be placed therethrough, said right first and second sleeve portions defining a right sleeve, said first and second garment left lateral sides cover the left side of the human body and said first and second garment right lateral sides cover the right side of the human body.

2. A garment assembly according to claim 1, wherein each said first left and right sleeve portion comprises a respective front side, a top shoulder portion and an open back side, each said second left and right sleeve portion comprises a respective open front side, a top shoulder portion and a back side.

3. A garment assembly according to claim 2, wherein when assembling a pair of said left first and second sleeve portions or a pair of said right first and second sleeve portions on a human body, said first and second top shoulder portions overlap and cover the shoulder of the human body, said first sleeve portion front side covers at least one portion of the arm of the human body, said second sleeve portion back side covers at least another portion of that arm.

4. A garment assembly according to claim 2, wherein said top shoulder portion of either one of said left and right first sleeve portions or either one of said left and right second sleeve portions comprises a detachable portion adjacent to a respective said arm opening.

5. A garment assembly according to claim 4, wherein said detachable portion comprises a fastener for being removably fastened about a contour defined by said respective arm opening.

6. A garment assembly according to claim 1, wherein at least one of said first and second garment elements comprises a pair of left and right shoulder portion adjacent to said left and right arm openings respectively, at least one of said left and right shoulder portions comprising a pair of mutually attachable and detachable parts.

7. A garment assembly according to claim 6, wherein each of said pair of attachable and detachable parts comprise respective fasteners for being removably fastened to one another.

8. A garment assembly according to claim 1, wherein each said sleeve portion comprises exposed edges, said exposed edges comprising a finishing.

9. A garment assembly according to claim 1, wherein said first left and right sleeve portions are configured to be respectively placed through said left and right second arm openings.

10. A garment assembly according to claim 1, wherein said second left and right sleeve portions are configured to be respectively placed through said left and right first arm openings.

11. A garment assembly for a human body comprising:

a first garment element comprising a top end having a first neck opening, left and right lateral sides having left and right first arm openings respectively, a first sleeve about said left first arm opening, a front side, a back side having an opening, and a bottom end, said front side extending from said top end to said bottom end and from said left lateral side to said right lateral side; and a second garment element being separate from said first garment element and comprising a top end having a second neck opening, left and right lateral sides having respective left and right second arm openings respectively, a second sleeve about said right first arm opening, a front side having an opening, a back side, and a bottom end, said back side extending from said top end to said bottom end and from said left lateral side to said right lateral side, wherein when assembling said separate first and second garment elements on a human body, said first and second neck openings provide for the neck of the human body to be placed therethrough, said first garment element front side covers the front of the human body, said second garment element back side covers the back of the human body, said left first and second arm openings provide for the left arm of the human body to be placed therethrough, said right first and second arm openings provide for the right arm of the human body to be placed therethrough, said first sleeve being placed through said left second arm opening, said second sleeve being placed through said right first arm opening, said first and second garment left lateral sides cover the left side of the human body and said first and second garment right lateral sides cover the right side of the human body.

12. A garment assembly for a human body comprising:

a first garment element comprising a top end having a first neck opening, left and right lateral sides having left and right first arm openings respectively, a first sleeve about said right first arm opening, a front side, a back side having an opening, and a bottom end, said front side extending from said top end to said bottom end and from said left lateral side to said right lateral side; and a second garment element being separate from said first garment element and comprising a top end having a second neck opening, left and right lateral sides having respective left and right second arm openings respectively, a second sleeve about said left first arm opening, a front side having an opening, a back side, and a bottom end, said back side extending from said top end to said bottom end and from said left lateral side to said right lateral side, wherein when assembling said separate first and second garment elements on a human body, said first and second neck openings provide for the neck of the human body to be placed therethrough, said first garment element front side covers the front of the human body, said second garment element back side covers the back of the human body, said left first and second arm openings provide for the left arm of the human body to be placed therethrough, said right first and second arm openings provide for the right arm of the human body to be placed therethrough, said first sleeve being placed through said right second arm opening, said second sleeve being placed through said left first arm opening, said first and second garment left lateral sides cover the left side of the human body and said first and second garment right lateral sides cover the right side of the human body.

13. A garment assembly according to claim 1, wherein said second garment front side opening defines a pair of separate and adjacent front side portions, said front side portions at least partially covering said first garment front side when assembled therewith.

14. A garment assembly according to claim 1, wherein said back side opening comprises a rectangular opening.

15. A garment assembly according to claim 1, wherein said front side opening comprises a rectangular opening.

16. A garment assembly according to claim 1, wherein said first garment front side comprises a pocket.

17. A garment assembly according to claim 1, wherein said bottom end defines an opening.

18. A garment assembly according to claim 1, wherein said first and second garment elements comprise respective interchangeable inner and outer sides.

19. A garment assembly according to claim 1, wherein said first and second garment elements comprise respective materials having different colors.

20. A garment assembly according to claim 1, wherein said first and second garment elements comprise respective materials having different patterns.

21. A garment assembly according to claim 1, wherein said first and second garment elements comprise different respective dimensions.

22. A garment assembly according to claim 1, wherein said first and second garment elements are identical.

* * * * *